United States Patent [19]

Terauchi

[11] Patent Number: 5,039,282

[45] Date of Patent: Aug. 13, 1991

[54] SLANT PLATE TYPE COMPRESSOR WITH VARIABLE DISPLACEMENT MECHANISM

[75] Inventor: Kiyoshi Terauchi, Isesaki, Japan

[73] Assignee: Sanden Corporation, Gunma, Japan

[21] Appl. No.: 342,079

[22] Filed: Apr. 24, 1989

[30] Foreign Application Priority Data

Apr. 23, 1988 [JP] Japan ..... 63-54123[U]

[51] Int. Cl.[5] ..... F04B 1/26

[52] U.S. Cl. ..... 417/222 S; 417/270

[58] Field of Search ..... 417/222 S, 270, 222, 417/271; 91/506; 92/212.2, 12.2

[56] References Cited

U.S. PATENT DOCUMENTS

| | | | |
|---|---|---|---|
| 4,586,874 | 5/1986 | Hiraga et al. | 417/222 S |
| 4,664,604 | 5/1987 | Terauchi | 417/222 S |
| 4,747,753 | 5/1988 | Taguchi | 417/222 S |
| 4,778,348 | 10/1988 | Kikuchi | 417/222 S |
| 4,842,488 | 6/1989 | Terauchi | 417/222 S |

*Primary Examiner*—Leonard E. Smith
*Assistant Examiner*—John A. Savio, III
*Attorney, Agent, or Firm*—Banner, Birch, McKie & Beckett

[57] ABSTRACT

A slant plate type compressor including a crank chamber and a suction chamber is disclosed. The slant plate is disposed in the crank chamber at a variable slant angle. The slant angle varies in dependence on the crank chamber pressure. The crank chamber is linked by a communication path to the suction chamber. The slant angle may be varied by controlling the link of the crank and suction chambers to thereby vary the capacity of the compressor. The link of the crank and suction chambers through the communication path is controlled by a valve mechanism. The valve mechanism includes a first valve control device which opens or closes the communication path in response to an external signal to vary the compressor capacity, and a second valve control device which is responsive to the suction pressure to open or close the communication path. The second valve control device acts to override the first valve control device and isolates the crank chamber from the suction chamber whenever the suction pressure is below a predetermined value. The first valve control device may be an electromagnetic valve and the second valve control device may be a bellows.

4 Claims, 1 Drawing Sheet

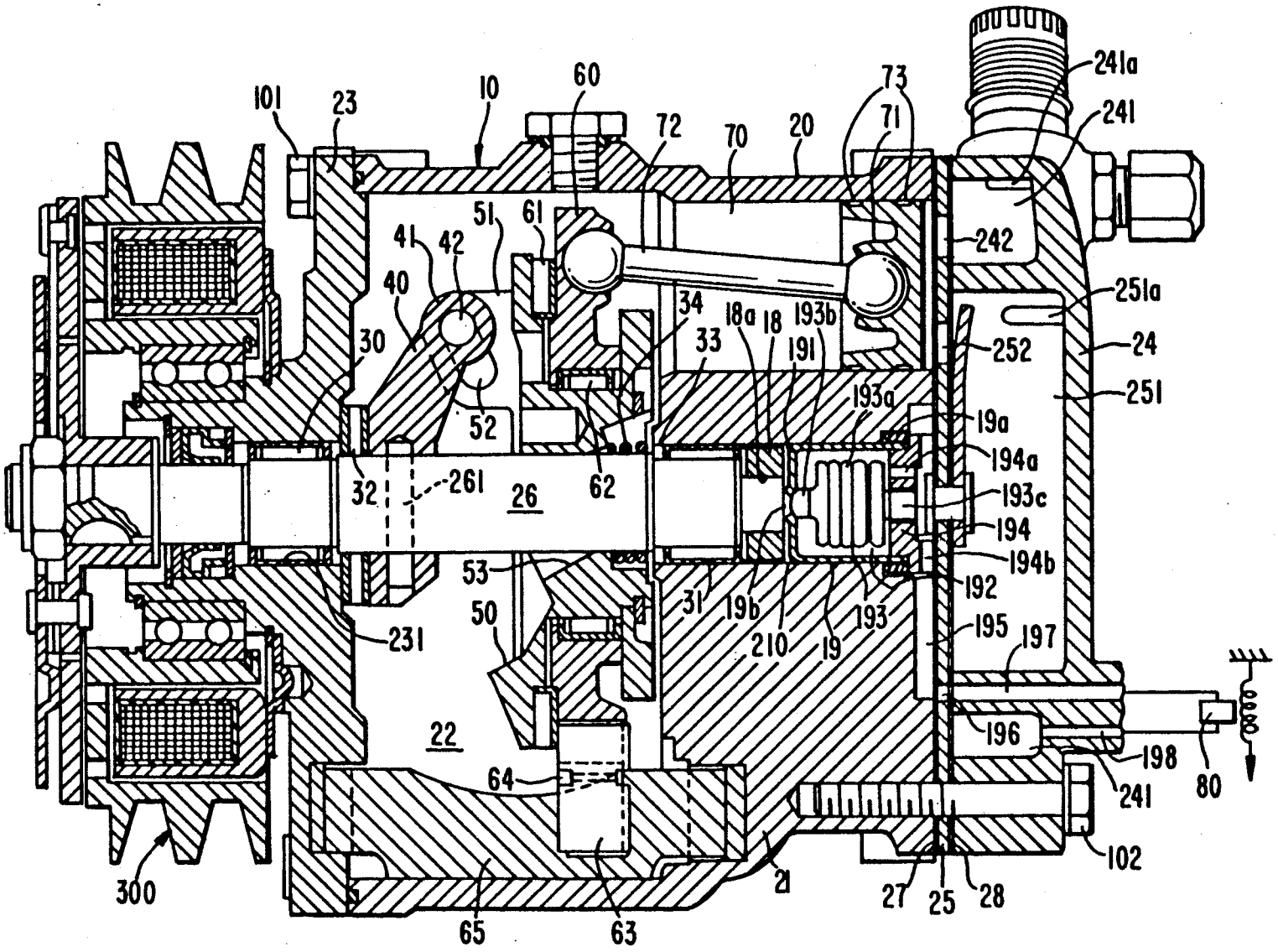
241a
241
242
251a
24
251
252
19a
194a
193c
194
194b
192
195
197
196
198
241
80
102
28
25
27
21
63
65
64
22
50
53
231
26
261
32
30
23
101
10
51
42
41
40
52
62
61
60
72
70
20
73
71
34
33
18a
18
191
193b
193a
193
19
210
19b
31
300

SLANT PLATE TYPE COMPRESSOR WITH VARIABLE DISPLACEMENT MECHANISM

BACKGROUND OF THE INVENTION

1. Field of the Invention

The present invention generally relates to a refrigerant compressor and, more particularly, to a slant plate type compressor, such as a wobble plate type compressor, with a variable displacement mechanism suitable for use in an automotive air conditioning system.

2. Description of the Prior Art

A wobble plate compressor with a variable displacement mechanism suitable for use in an automotive air conditioning system is disclosed in U.S. Pat. No. 3,861,829 issued to Roberts et al. As disclosed therein, the compression ratio of the compressor may be controlled by changing the slant angle of the inclined surface of the wobble plate. The slant angle of the wobble plate is adjusted in response to a change in the crank chamber pressure which is generated by controlling communication between the suction chamber and the crank chamber.

In Japanese Patent Application Publication No. 60-135,680 corresponding to U.S. Pat. No. 4,586,874, the communication between the suction chamber and the crank chamber is controlled by an electromagnetic value which operates in response to an external signal, such as an electrical ON/OFF signal having a variable ON/OFF ratio. An ON signal and an OFF signal result in the communication between the suction chamber and the crank chamber being accomplished and being blocked, respectively. Therefore, when the communication between the suction chamber and the crank chamber is controlled with a high ON ratio signal, the crank chamber is substantially maintained at the suction chamber pressure, and thereby the compressor operation is maintained at maximum displacement.

Accordingly, when the electromagnetic valve receives a high ON ratio signal during operation of the compressor at an extremely high revolution rate, an unusually large decrease of the suction chamber pressure occurs such that frictional members of the compressor may be damaged. For example, seizure of the frictional members due to a large reduction of the lubricating oil flowing in the compressor may result.

SUMMARY OF THE INVENTION

It is an object of this invention to provide a variable capacity slant plate type compressor in which an externally controlled valve control mechanism controls the communication between the suction chamber and the crank chamber such that an unusually large decrease of the suction chamber pressure is prevented.

The slant plate type compressor in accordance with the present invention includes a compressor housing having a cylinder block with a front end plate and a rear end plate attached thereto. A crank chamber is defined between the front end plate and the cylinder block and a plurality of cylinders are formed in the cylinder block. A piston is slidably fitted within each of the cylinders. A drive mechanism is coupled to the pistons to reciprocate the pistons within the cylinders. The drive mechanism includes a drive shaft rotatably supported in the compressor housing, a rotor coupled to the drive shaft and rotatable therewith, and a coupling mechanism for drivingly coupling the rotor to the pistons such that rotary motion of the rotor is converted into reciprocating motion of the pistons. The coupling mechanism includes a slant plate having a surface disposed at a slant angle relative to a plane perpendicular to the drive shaft. The slant angle changes in response to a change in pressure in the crank chamber to change the capacity of the compressor.

The rear end plate includes a suction chamber and a discharge chamber defined therein. A communication path links the crank chamber with the suction chamber. A valve control mechanism controls the opening and closing of the communication path to change the pressure in the crank chamber. The valve control mechanism includes first and second valve control devices disposed in series within the communication path and each controlling the opening of the communication path. The second valve control device operates in response to pressure in the suction chamber. The first valve control device operates in response to an external signal. When the pressure in the suction chamber falls below a predetermined value, the second valve control device prevents the crank chamber from being linked to the suction chamber even if the first valve control device receives an external signal which would cause it to allow the chambers to be linked.

BRIEF DESCRIPTION OF THE DRAWING

The single FIGURE is a sectional view of a wobble plate type refrigerant compressor in accordance with one embodiment of this invention.

DETAILED DESCRIPTION OF THE PREFERRED EMBODIMENT

Although the present invention is described below in terms of a wobble plate type compressor, it is not limited in this respect. The present invention is broadly applicable to all slant plate type compressors.

A wobble plate type refrigerant compressor in accordance with the present invention is shown in the drawing. Compressor 10 includes cylindrical housing assembly 20 including cylinder block 21, front end plate 23 disposed at one end of cylinder block 21, crank chamber 22 formed between cylinder block 21 and front end plate 23, and rear end plate 24 attached to the other end of cylinder block 21. Front end plate 23 is secured to one end of cylinder block 21 by a plurality of bolts 101. Rear end plate 24 is secured to the opposite end of cylinder block 21 by a plurality of bolts 102. Valve plate 25 is disposed between rear end plate 24 and cylinder block 21. Opening 231 is formed centrally in front end plate 23 for supporting drive shaft 26 through bearing 30 disposed therein. The inner end portion of drive shaft 26 is rotatably supported by bearing 31 disposed within central bore 210 of cylinder block 21. Bore 210 extends to a rearward (to the right in the drawing) end surface of cylinder block 21 and contains first valve control device 19 therein, behind the terminal end of drive shaft 26.

Cam rotor 40 is fixed on drive shaft 26 by pin member 261 and rotates therewith. Trust needle bearing 32 is disposed between the inner end surface of front end plate 23 and the adjacent axial end surface of cam rotor 40. Cam rotor 40 includes arm 41 having pin member 42 extending therefrom. Slant plate 50 is disposed adjacent cam rotor 40 and includes opening 53 through which drive shaft 26 passes. Slant plate 50 includes arm 51 having slot 52. Cam rotor 40 and slant plate 50 are coupled by pin member 42 which is inserted in slot 52 to form a hinged joint. Pin member 42 slides within slot 52 to allow adjustment of the angular position of slant plate 50 with respect to a plane perpendicular to the longitudinal axis of drive shaft 26.

Wobble plate 60 is nutarably mounted on slant plate 50 through bearings 61 and 62. Fork shaped slider 63 is attached to the outer peripheral end of wobble plate 60 by pin member 64 and is slidably mounted on sliding rail 65 disposed between front end plate 23 and cylinder block 21. Fork shaped slider 63 prevents rotation of wobble plate 60. Wobble plate 60 nutates along rail 65 when cam rotor 40 and slant 50 rotate. Cylinder block 21 includes a plurality of peripherally located cylinder chambers 70 in which pistons 71 reciprocate. Each piston 71 is coupled to wobble plate 60 by a corresponding connecting rod 72.

A pair of seamless piston rings 73 made of polytetrafluoroethylene are disposed at an outer peripheral surface of pistons 71. Piston rings 73 prevent the wear of both aluminum alloy pistons 71 and aluminum alloy cylinder block 21 due to friction therebetween by preventing any direct contact between pistons 71 and the inner surfaces of cylinders 70.

Rear end plate 24 includes peripherally positioned annular suction chamber 241 and centrally positioned discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu.

Suction chamber 241 includes inlet portion **241*a* which is connected to an evaporator of an external cooling circuit (not shown). Discharge chamber 251 is provided with outlet portion 251*a* connected to a condenser of the cooling circuit (not shown). Gaskets 27 and 28 are positioned between cylinder block 21 and the inner surface of valve plate 25 and the outer surface of valve plate 25 and rear end plate 24 respectively. Gaskets 27 and 28 seal the mating surfaces of cylinder block 21, valve plate 25 and rear end plate 24**.

Snap ring 33 is attached to drive shaft 26 to be adjacent to an open end of bore 210 (to the left in drawing). Bias spring 34 is mounted on drive shaft 26 and is located between rear end surface of slant plate 50 (to the right in drawing) and snap ring 33 so as to continuously urge slant plate 50 towards the maximum slant angle thereof with respect to a plane perpendicular to the axis of drive shaft 26, that is, the angle of maximum compressor displacement.

First valve control device 19 including cup-shaped casing member 191 is disposed within central bore 210. Cup-shaped casing member 191 defines valve chamber 192 therein. O-ring **19*a* is disposed at an outer surface of casing member 191 to seal the mating surface of casing member 191 and cylinder block 21. Circular plate 194 having hole 194*a* is fixed to an open end (to the right in drawing) of cup-shaped casing member 191, maintaining axial gap 194*b* between valve plate 25 and the rear surface thereof. Screw member 18 for adjusting an axial location of drive shaft 26 is disposed between the inner end of drive shaft 26 and a closed end (to the left in drawing) of cup-shaped casing 191. Screw member 18 includes hole 18*a* formed at a center thereof. Hole 19*b* is formed at a center of the closed end of casing member 191 and faces hole 18*a***.

Second valve control device 19 further includes valve member 193 including bellows **193*a*, valve element 193*b* attached to a top end (to the left in drawing) of bellows 193*a* and male screw element 193*c* attached to a bottom end (to the right in drawing) of bellows 193*a*. Bellows 193*a* is charged with gas to maintain a predetermined range of pressure, for example, 1.0–1.2 KG/cm G, which corresponds to the permitted range for the normal lowest opeating pressure in suction chamber 241. That is, the suction pressure should not be allowed to fall below this range of values during operation. Male screw element 193*c* is screwed into circular plate 194 to firmly secure the bottom end of bellows 193*a* to circular plate 194**.

First conduit 195 is formed at a rear end (to the right in drawing) of cylinder block 21 extending radially from gap **194*b*, and terminating at hole 196 formed through valve plate 25. Second conduit 197 axially extending from hole 196 is formed through rear end plate 24 and terminates at one end of electromagnetic valve 80 which functions as a first valve control device. Third conduit 198 axially extending from the other end of electromagnetic valve 80 is also formed through rear end plate 24 and terminates at suction chamber 241. Therefore, a communication path between crank chamber 22 and suction chamber 241 is obtained and includes gaps maintained between bearing 31 and both the outer peripheral surface of drive shaft 26 and the inner wall of bore 210, hole 18*a*, hole 19*b*, valve chamber 192, hole 194*a*, gap 194*b*, first conduit 195, hole 196, second conduit 197 and third conduit 198. Accordingly, bellows 193*a* contracts and expands longitudinally to close and open hole 19*b* in response to pressure in suction chamber 241 which is linked to valve chamber 192 by the conduits and holes. Additionally, electromagnetic valve 80 controls the communication between second conduit 197 and third conduit 198 in response to an external signal, such as, an electrical ON/OFF signal having a variable ON/OFF ratio to control the link between valve chamber 192 and suction chamber 241**.

During operation of compressor 10, drive shaft 26 is rotated by the engine of the vehicle (not shown) through electromagnetic clutch 300. Cam rotor 40 is rotated with drive shaft 26 causing slant plate 50 to rotate. The rotation of slant plate 50 causes wobble plate 60 to nutate. The nutating motion of wobble plate 60 reciprocates pistons 71 in their respective cylinders 70. As pistons 71 are reciprocated, refrigerant gas is introduced into suction chamber 241 through inlet portion **241*a*, and is drawn into cylinders 70 through suction ports 242 and subsequently compressed. The compressed refrigerant gas is discharged from cylinders 70 to discharge chamber 251 through respective discharge ports 252 and then into the cooling circuit through outlet portion 251*a***.

When electromagnetic valve 80 receives a low OFF ratio signal, the communication between second conduit 197 and third conduit 198 is substantially blocked. Therefore, the communication between crank chamber 22 and suction chamber 241 is substantially blocked regardless of the operation of second valve control device 19 which operates directly in response to the pressure in suction chamber 241 to control the link between the crank and suction chambers. Accordingly, the pressure in crank chamber 22 is gradually increased due to compressed refrigerant gas blown through a gap between pistons 71 and cylinders 70, thereby causing the slant angle of wobble plate 60 to be decreased against the urging force of bias spring 34. Therefore, the compressor displacement is minimized.

However, when electromagnetic valve 80 receives a high ON ratio signal, the communication between second conduit 197 and third conduit 198 is substantially accomplished. Therefore, when the pressure in suction chamber 241 exceeds the pressure in bellows 193*a* and bellows 193*a* contracts to open hole 19*b*, the communication between crank chamber 22 and suction chamber 241 is substantially accomplished. Accordingly, the pressure in crank chamber 22 is decreased to the pressure in suction chamber 241 and the slant angle of wobble plate 60 is maximized to maximize the compressor displacement. Operation of compressor 10 under maximum displacement also causes the pressure in suction chamber 241 to be decreased.

However, when the pressure in suction chamber 241 is below the pressure in bellows 193*a*, when the electromagnetic valve receives a high ON signal, bellows 193*a* will expand to close hole 19*b*, and communication between crank chamber 22 and suction chamber 241 will be substantially blocked even though second conduit 197 and third conduit 198 are linked. Thus even if the electromagnetic valve receives the high ON ratio signal during operation of the compressor at extremely high revolution, an unusually large decrease of the suction chamber pressure is prevented. Since the crank and suction chambers are not linked by the communication path due to the expansion of the bellows when the suction pressure falls below the predetermined range, the suction pressure cannot be reduced any further below this value. Therefore compressor damage such as seizure of frictional members of the compressor is prevented. Accordingly, pressure in crank chamber 22 is gradually increased due to refrigerating gas blown through the gaps between pistons 71 and cylinders 70, thereby minimizing the compressor displacement.

Furthermore, the electromagnetic valve may receive a simple ON/OFF signal which is alternated with the ON/OFF signal having the variable ON/OFF ratio.

This invention has been described in connection with the preferred embodiments. These embodiments, however, are merely for example only and the invention is not restricted thereto. It will be understood by those skilled in the art that other variations and modifications can easily be made within the scope of this invention as defined by the claims.

I claim:

1. In a slant plate type compressor including a compressor housing enclosing a crank chamber, a suction chamber and a discharge chamber therein, said compressor housing comprising a cylinder block having a plurality of cylinders, a piston slidably fitted within each of said cylinders, a drive means coupled to said pistons for reciprocating said pistons within said cylinders, said drive means including a drive shaft rotatably supported in said housing, coupling means for drivingly coupling said pistons with said drive shaft and for converting rotary motion of said drive shaft into reciprocating motion of said pistons, said coupling means including a slant plate having a surface disposed at a slant angle relative to a plane perpendicular to said drive shaft, the slant angle changing in response to a change in pressure in said crank chamber to change the capacity of said compressor, a communication path linking said crank chamber with said suction chamber, a valve control mechanism controlling the opening and closing of said communication path to cause a change in pressure in said crank chamber, said valve control mechanism including a first valve control means operating in response to an external signal for controlling the link between said crank chamber and said suction chamber through said path, the improvement comprising:

said valve control mechanism comprising a second valve control means disposed in said communication path in series with said first valve control means, said second valve control means responsive to the pressure in said communication path for controlling the communication link between said suction chamber and said crank chamber through said communication path, said first valve-control means disposed in said communication path between said suction chamber and said second valve control means.

2. The compressor recited in claim 1, said first valve control means comprising an electromagnetic valve.

3. The compressor recited in claim 1, said compressor housing comprising a rear end plate disposed on one end of said cylinder block, said discharge chamber and said suction chamber enclosed within said rear end plate by said cylinder block, said communication path including first and second conduits formed in said rear end plate, said first valve control means disposed on the exterior of said compressor housing to link said first and second conduits in fluid communication when said first valve control means is open.

4. The compressor recited in claim 3, said coupling means further comprising a rotor linked to said drive shaft and rotatable therewith, said rotor linked to said slant plate, a wobble plate nutatably disposed on said slant plate, each said piston connected to said wobble plate by a connecting rod, said slant plate rotatable with respect to said wobble plate, rotation of said drive shaft, said rotor and said slant plate causing nutation of said wobble plate, nutation of said wobble plate causing said pistons to reciprocate in said cylinders.

* * * * *